US005207019A

United States Patent [19]

Massey et al.

[11] Patent Number: 5,207,019

[45] Date of Patent: May 4, 1993

[54] DISPLAY DEVICE

[76] Inventors: Catherine C. Massey; Roger C. Massey, both of Hill Farm House, Hittisleigh, Exerter, Devon EX6 6LQ, England

[21] Appl. No.: 674,121

[22] Filed: Mar. 25, 1991

[51] Int. Cl.[5] ..... A01G 5/00

[52] U.S. Cl. ..... 47/41.01; 47/67; 40/156

[58] Field of Search ..... 47/41.01, 41.12, 41.13; 40/152, 156

[56] References Cited

U.S. PATENT DOCUMENTS

| | | | |
|---|---|---|---|
| 1,601,479 | 9/1926 | Parda | 40/156 |
| 1,777,944 | 10/1930 | Trovato | 47/41.01 |
| 2,312,007 | 2/1943 | Thrasher | 47/41.01 |
| 2,556,283 | 6/1951 | Lieberman | 40/152 |
| 2,686,988 | 8/1954 | Garber | 40/152 |
| 2,814,895 | 12/1957 | Flam | 47/41.01 |
| 3,237,332 | 3/1966 | Petrey | 40/152 |

FOREIGN PATENT DOCUMENTS

| | | | |
|---|---|---|---|
| 782613 | 6/1935 | France | 47/41.01 |
| 2475384 | 8/1981 | France | 40/152 |
| 21990 | of 1914 | United Kingdom | 47/41.01 |

*Primary Examiner*—Henry E. Raduazo

[57] ABSTRACT

A display device for use in the display of flowers includes a backing sheet, a peripheral frame and a removable water container located behind a cover panel. The cover panel may be of the same material as the backing sheet.

5 Claims, 1 Drawing Sheet

DISPLAY DEVICE

FIELD OF THE INVENTION

This invention relates to display devices for displaying cut flowers or other plant material, for example, dried flowers or silk flowers. The invention is specifically concerned with that kind of display device which is intended to be mounted on a wall and includes a picture frame so as to show off or display the plant material to the best advantage.

BACKGROUND OF THE INVENTION

Numerous devices have previously been proposed for displaying plant material. One example of such a device is that of Barrington in British Patent Specification No. 619240. Barrington discloses a picture frame with which a vase is associated, the base being formed with a flat rear wall from which a hook projects for engagement in a slot in a backing member of the picture frame.

Another example of such a device is that of Lufkin in U.S. Pat. No. 4212133. Lufkin discloses a picture frame with a rectangular opening in the picture area to allow the stems of flowers to pass from the front of the frame to the back of the frame. At the back of the frame, there is a water container which is located directly beneath the rectangular opening, the configuration of the container being such as to hold the stems of the flowers in such way that the flowers remain upright against the front face of the picture area.

It is an object of the present invention to provide a display device which is simple to manufacture but which enables an arrangement of flowers to be displayed in such way as to achieve the maximum visual impact. It is a further object to achieve this visual impact without the viewer being able to see the container in which the flowers are displayed. For example, with the picture frame design of Barrington referred to above, the vase in which the flowers are placed is visible. However, attractive the vase, this can but detract from the visual impact derived from the flower arrangement.

It is a further object of the present invention to provide a display device which can be hung on a wall and in which access can be obtained to the container in which the flower stems are located without removing the device from the wall or other supporting surface on which the device is being displayed.

It is a still further object to provide a display device in which the container in which the flower stems are located is readily removable for cleaning purposes. This is in contrast to the arrangement of Lufkin in which the water container is so positioned that access thereto can only be obtained by taking the display device down from the wall. Furthermore, the water container of Lufkin is either permanently attached to the picture frame or is formed as a one-piece plastic moulding with the frame. Cleaning of the water container of Lufkin is thus either difficult or impossible.

SUMMARY OF THE INVENTION

A display device in accordance with the present invention comprises:

a) a backing sheet for mounting vertically on a wall, said backing sheet having a front face and a rear face, b) a peripheral frame surrounding and attached to the backing sheet, c) a cover panel located forwardly of and spaced from the lower portion of the backing sheet, said cover panel having a front face and a rear face, d) a chamber defined between the rear face of the cover panel and said lower portion of the front face of the backing sheet, which chamber is upwardly open, and e) a removable water container located in said chamber in such manner that flowers can be placed in position within the display device with the stems of the flowers within the container and with the heads of the flowers located forwardly of the upper portion of the front face of the backing sheet.

DESCRIPTION OF THE PREFERRED EMBODIMENT

Figure 1:
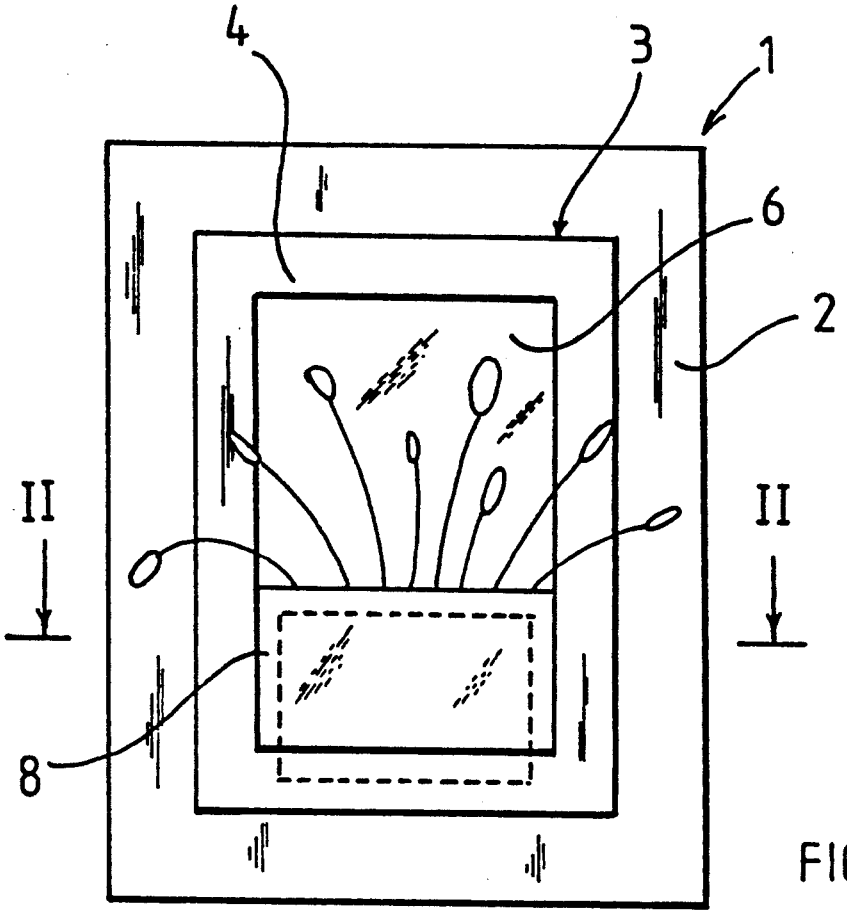
FIG. 1 is a front view of a display device in accordance with the invention.
Figure 2:
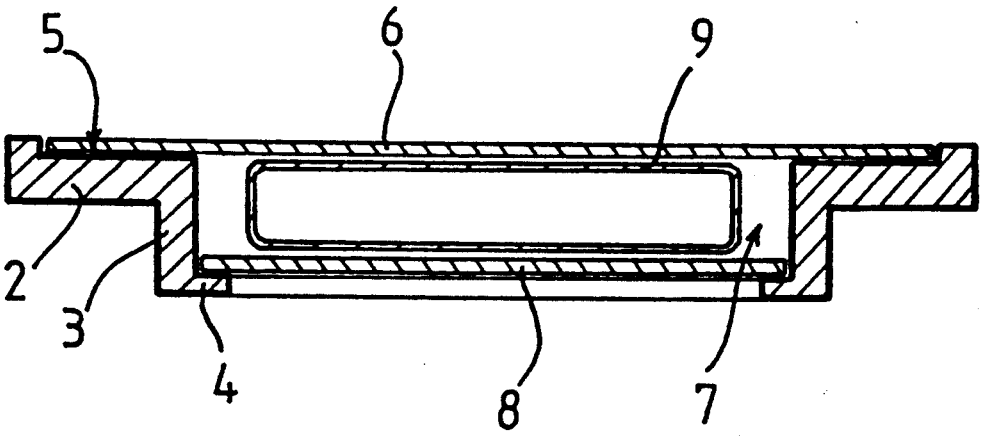
FIG. 2 is a sectional view of the display device along the section line II—II of FIG. 1.

The display device show in the drawings includes a rectangular frame 1. It is to be understood, however, that the frame 1 can be of any other appropriate configuration. In particular, the frame may be of circular form. In transverse section, the frame 1 includes a peripheral, outwardly directed limb 2 with a substantially perpendicular, forwardly directed limb 3 extending around the inner edge of limb 2. The frame 1 can thus be considered as being of generally L-shaped in cross-section with the foot of the L extending forwardly away from a wall against which the device is hung and with the stem of the L extending parallel to the wall. The extreme front edge of the inner limb 3, i.e. the free end of the foot of the L, terminates in a substantially perpendicular, inwardly directed flange 4.

The rear face of the outer limb 2 of the frame 1 has an internal recess 5 to locate a rigid or semi-rigid backing sheet 6. The back face of the backing sheet 6 rests against a wall on which the frame 1 is hung by means of a hook, eye or other means (not shown). The front face of the backing sheet 6 is covered with a decorative material, such as hessian or acrylic velour and is coloured so as to contrast with the frame 1 which is preferably of wood but may alternatively be formed of a metal or plastics material.

The backing sheet 6 is secured to the frame 1 by adhesive, adhesive tape or in any other convenient manner. The space 7 enclosed within the frame 1 and bounded at the rear by the backing sheet 6 is open to the front of the device, and remains substantially so in use. A cover panel 8 is, however, attached to the frame 1 behind the flange 4 so as to enclose the lower portion of the space 7. As can be seen from FIG. 1, the height of the cover panel 8 is approximately one third of the height of the backing sheet 6. The front face of the cover panel 8 is covered with a decorative material, such as hessian or acrylic velour, and preferably the same material as that with which the backing sheet 6 is covered.

The cover panel 8 is disposed in front of the lower portion of the backing sheet 6 so that a chamber is provided within the confines of the frame 1, this chamber being open-topped and extending for the full width of the lower portion of the frame 1. A rectangular cross-section, open-topped, moulded plastic container 9 is located within this chamber, the position of the container 9 being indicated in broken lines in FIG. 1.

The open-topped container 9 rests on the lower part of the frame 1, the height of the container 9 being less than the height of the cover panel 8 so that, when the display device is viewed from the front, the container 9 is not visible. The cover panel 8 not only covers the container 9 but also serves to hold it in place. The container 9 can easily be removed for cleaning purposes or for changing a flower arrangement without it being necessary to take the device down from the wall.

In use, the display device is hung on a wall with a quantity of water disposed within the container 9. Cut flowers or other live plant material may thus be placed with their cut stems in the container 9 and with their heads visible. An important feature of the display device is that the plant material is not just confined to the display space 7 enclosed by the frame 1 but may project forwardly of the frame 1, and even outwardly beyond the confines of the frame 1, to give an aesthetically pleasing three-dimensional effect.

As an alternative to the use of live cut flowers, dried flowers or grasses or other dried plant material may be placed in the container 9, in which case no water will be necessary. The device can, of course, also be used for the display of silk or other artificial flowers.

As illustrated, the container 9 occupies substantially the full width of the space 7 within the frame 1. However, particularly in the case of horizontally elongate frames, the container 9 may occupy only a proportion of the width of the frame 1. The position of the container 9 will then be adjustable laterally of the frame 1 in order to vary the decorative effect of the plant material.

The flange 4 may be no more than a small lip, i.e. merely sufficient to provide location for the edge of the cover panel 8. The forwardly facing surfaces of the frame 1 may be of a relatively simple profile, with simple mitred joints at the four corners of the frame. Fancy profiles may, however, be provided, depending on the visual effect that the manufacturer of the display device is seeking to achieve. The recess 5 at the rear of the frame 1 may also be omitted and the backing sheet 6 simply attached to the rear faces of limbs 2 of the frame 1.

We claim:

1. A display device comprising:

a) a backing sheet for mounting vertically on a wall, said backing sheet having a front face and a rear face, b) a peripheral frame surrounding and attached to the backing sheet, c) a cover panel located forwardly of and spaced from the lower portion of the backing sheet, said cover panel having a front face and a rear face, d) a chamber defined between the rear face of the cover panel and said lower portion of the front face, which chamber is upwardly open, and e) a removable water container located in said chamber in such manner that flowers can be placed in position within the display device with the stems of the flowers within the container and with the heads of the flowers located forwardly of the upper portion of the front face of the backing sheet.

2. A display device according to claim 1, in which the front face of the backing sheet and the front face of the cover panel are covered with a decorative material selected from the group comprising hessian and velour.

3. A display device for use in the displaying of flowers, said display device comprising:

a) a backing sheet for mounting vertically on a wall, said backing sheet having a front face and a rear face and including an upper portion and a lower portion, b) a peripheral frame surrounding and attached to the backing sheet, c) said peripheral frame being of L-shape in cross-section with the stem of the L extending parallel to the plane of the backing sheet and the foot of the L extending forwardly of the front face of the backing sheet and at right angles thereto, d) a cover panel located forwardly of and spaced from the lower portion of the backing sheet, said cover panel having a front face and a rear face, e) said cover panel being attached to the foot of the L-shaped frame and cooperating with the backing sheet to define an upwardly open chamber, which chamber is defined between the rear face of the cover panel and said lower portion of the front face of the backing sheet, and f) a removable water container located in said chamber in such manner that flowers can be placed in position within the display device with the stems of the flowers within the container and with the heads of the flowers located forwardly of the upper portion of the front face of the backing sheet.

4. A display device according to claim 3, in which the foot of the L of the peripheral frame terminates in an inwardly directed flange and in which the cover panel is attached to and is located behind said inwardly directed flange.

5. A display device according to claim 4, in which the front face of the backing sheet and the front face of the cover panel are covered with a decorative material selected from the group comprising hessian and velour, the height of the cover panel being approximately one third the height of the backing sheet.

* * * * *